US008381698B2

(12) United States Patent
Takano

(10) Patent No.: US 8,381,698 B2
(45) Date of Patent: Feb. 26, 2013

(54) VEHICLE PROVIDED WITH ENGINE AND ENGINE

(75) Inventor: Kiyohito Takano, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 688 days.

(21) Appl. No.: 12/647,159

(22) Filed: Dec. 24, 2009

(65) Prior Publication Data

US 2010/0162990 A1 Jul. 1, 2010

(30) Foreign Application Priority Data

Dec. 26, 2008 (JP) ..... P2008-332656

(51) Int. Cl.
*F01M 1/02* (2006.01)
*F01M 9/10* (2006.01)
*F01M 11/02* (2006.01)

(52) U.S. Cl. ..... 123/196 R

(58) Field of Classification Search ..... 123/196 R, 123/196 CP, 196 AB
See application file for complete search history.

(56) References Cited

U.S. PATENT DOCUMENTS

| | | | | |
|---|---|---|---|---|
| 5,669,479 | A * | 9/1997 | Matsufuji | 192/85.63 |
| 6,786,188 | B1 * | 9/2004 | Kawamoto | 123/196 R |
| 6,823,829 | B1 * | 11/2004 | Kawamoto et al. | 123/196 R |
| 7,059,443 | B2 * | 6/2006 | Kira | 180/243 |

FOREIGN PATENT DOCUMENTS

JP 2006-105132 4/2006

* cited by examiner

*Primary Examiner* — Nathaniel Wiehe
*Assistant Examiner* — Maria Aponte
(74) *Attorney, Agent, or Firm* — Wenderoth, Lind & Ponack, LLP

(57) ABSTRACT

A center line of a cylinder of an engine of the present invention is inclined by an inclination angle of 60° or more relative to a vertical direction. The engine is provided with a first oil communication hole or opening providing communication between a crank chamber and a rotor housing chamber so as to distribute oil, and a second oil communication hole or opening providing communication between the rotor housing chamber and a transmission chamber so as to distribute the oil. The second oil communication hole opening is arranged at a position where the oil remains in an oil pan when the vehicle is inclined.

11 Claims, 11 Drawing Sheets

VEHICLE PROVIDED WITH ENGINE AND ENGINE

BACKGROUND OF THE INVENTION

1. Field of the Invention

The present invention relates to a vehicle provided with an engine and the engine, more particularly to a vehicle provided with an engine including an oil circulation route having an oil pan in a lower end of a transmission chamber of a crank case, and the engine.

2. Description of the Prior Art

One example of the oil circulation route in the vehicle engine having the oil pan in the lower end of the transmission chamber will be briefly described. Oil suctioned from the oil pan by an oil pump is supplied to oil feeding points of the engine such as a bearing of a crankshaft, a crank pin, a piston, a clutch, a generator, a cam shaft of a cylinder head, and a transmission shaft via oil passages for oil supply and then utilized for lubrication and/or cooling at the oil feeding points. The supplied (used) oil is returned to the oil pan of the transmission chamber via oil passages for oil return of the points, a crank chamber, a clutch chamber or a generator chamber and the like. Such an oil circulation route is described, for example, in Japanese Unexamined Patent Publication No. 2006-105132.

In order to suction the oil without air entrainment by the oil pump at the time of driving the vehicle so as to properly supply the oil to the feeding points, there is a need for always leaving the oil in the oil pan within a range of a predetermined oil level. Therefore, there is a conventional engine provided with a scavenging pump in the engine separately from the oil pump. That is, the oil returning from the oil feeding points to the crank chamber, the generator chamber, the clutch chamber and the like is forcibly pumped up by the scavenging pump and returned to the oil pan of the transmission chamber. However, in a case where the scavenging pump is provided, the number of parts and cost are increased. Since the scavenging pump is driven by utilizing rotation of the crankshaft of the engine, an output of the engine is also decreased.

Meanwhile, in a case where the scavenging pump is not provided, the cost of parts can be reduced and there is no loss in the output of the engine. However, depending on a driving situation of the vehicle, for example when the vehicle is inclined forward, rearward, leftward or rightward at the time of driving on a slope or the like, there is sometimes a case where an oil amount in the oil pan becomes insufficient due to movement of the oil in the oil pan, or too much oil is gathered in a chamber other than the oil pan.

SUMMARY OF THE INVENTION

The present invention is achieved in consideration with the above problems, and an object of the present invention is to provide a vehicle for always leaving oil in an oil pan within a range of a predetermined level and preventing excessive gathering of the oil in a chamber other than the oil pan, irrespective of a driving situation of the vehicle such as driving on a downward slope, idling or driving on an upward slope, thereby to maintain a favorable state of an oil circulation.

A first aspect of the present invention is a vehicle provided with an engine having a single cylinder with the following configuration. The engine includes: a) a crank case having a crank chamber housing a crankshaft, and a transmission chamber housing a transmission and including an oil pan in a lower end thereof; b) a single cylinder coupled with the crank case, the cylinder having a center line inclined forward by an inclination angle of 60° or more relative to a vertical direction; c) a cover member attached to one end of the crank case in the crankshaft direction, the cover member having a rotor housing chamber housing a rotor; d) a first oil communication hole or opening formed at a side wall of the crank case between the crank chamber and the rotor housing chamber for providing communication between both the chambers so as to distribute oil; e) a second oil communication hole or opening formed at the side wall of the crank case between the rotor housing chamber and the transmission chamber for providing communication between both the chambers so as to distribute the oil; and f) an oil pump communicating with an oil intake port formed in the oil pan, in which g) the second oil communication hole or opening is arranged at a position substantially corresponding to a lower end of the rotor housing chamber above the oil intake port where the oil remains in the oil pan when the vehicle is inclined by a predetermined angle substantially corresponding to a complementary angle of the inclination angle of the cylinder relative to a substantially horizontal direction. The rotor housing chamber is for example a generator chamber housing a generator or a clutch chamber housing a clutch.

According to the above configuration, at the time of driving the vehicle, it is possible to promptly return the oil in the crank chamber to the oil pan of the transmission chamber via the first oil communication hole or opening, the rotor housing chamber (such as the generator chamber) and the second oil communication hole or opening. Moreover, even at the time of driving the vehicle inclined on the cylinder inclination side (such as forward), it is possible to leave a predetermined amount of the oil in the oil pan. Therefore, it is possible to prevent air entrainment by the oil pump.

In the first aspect of the present invention, preferably, the first oil communication hole or opening is arranged at a position in proximity to a lower end of the crank chamber seen in the crankshaft direction where an oil level in the crank chamber is maintained so that the oil in the crank chamber does not flow into the cylinder when the vehicle is inclined by the predetermined angle.

According to the above configuration, at the time of driving the vehicle inclined by the predetermined angle in the cylinder inclination direction, a flow of the oil from the crank chamber into the cylinder is suppressed. Therefore, it is possible to maintain smooth sliding of a piston without disturbing movement of the piston in the cylinder by the oil.

In the first aspect of the present invention, preferably, a bottom wall of the crank chamber has an oil discharge hole or opening for discharging the oil in the crank chamber to the transmission chamber by rotation of the crankshaft. In this case, a peripheral wall of the crank chamber may have a ventilation hole or opening for providing communication between an interior and an exterior of the crank chamber so as to distribute gas.

According to the above configuration, it is possible to actively and promptly discharge the oil in the crank chamber from the oil discharge hole or opening by utilizing the rotation of the crankshaft in addition to oil discharge from the first oil communication hole or opening. By forming the ventilation hole or opening, it is possible to absorb a pressure change in the crank chamber so as to facilitate oil coming in and out of the crank chamber.

A second aspect of the present invention is a vehicle provided with a V-type engine characterized by the following constituent requirement b') instead of the constituent requirement b) of the first aspect. The other constituent requirements a), c) to g) are the same as in the first aspect.

The vehicle is provided with an engine including b') a pair of front and rear cylinders coupled with the crank case in a V-type arrangement, the front cylinder having a center line inclined forward by an inclination angle of 45° or more relative to a vertical direction and the rear cylinder having a center line inclined so as to make a predetermined angle relative to the center line of the front cylinder.

Therefore, according to the second aspect, it is possible to obtain the same effect as the first aspect in the V-type engine.

A third aspect of the present invention is a vehicle characterized by the following constituent requirement g') instead of the constituent requirement g) of the first aspect. The other constituent requirements a), b), c), d), e) and f) are the same as in the first aspect.

g') The second oil communication hole or opening is arranged at a position substantially corresponding to a lower end of the rotor housing chamber above the oil intake port where a line passing through a lower part of the second oil communication hole or opening in parallel to the center line of the cylinder runs higher than the oil intake port.

In the third aspect of the present invention, preferably, the first oil communication hole or opening is arranged at a position in proximity to a lower end of the crank chamber seen in the crankshaft direction where an angle between a line connecting a lower part of the first oil communication hole or opening and a lower end of a bore portion of the crank case and a vertical line is the inclination angle of the cylinder or more.

A fourth aspect of the present invention is a vehicle characterized by the following constituent requirement g') instead of the constituent requirement g) of the second aspect. The other constituent requirements a), b'), c), d), e) and f) are the same as in the second aspect.

g') The second oil communication hole or opening is arranged at a position substantially corresponding to a lower end of the rotor housing chamber above the oil intake port where a line passing through a lower part of the second oil communication hole or opening in parallel to the center line of the cylinder runs higher than the oil intake port.

The present invention relates to the engine itself to provide a single-cylinder engine characterized by the constituent requirements a), b), c), d), e), f) and g') of the third aspect.

In the above engine, preferably, the first oil communication hole or opening is arranged at a position in proximity to a lower end of the crank chamber seen in the crankshaft direction where an angle between a line connecting a lower part of the first oil communication hole or opening and a lower end of a bore portion of the crank case and a vertical line is the inclination angle of the cylinder or more.

Further, the present invention also provides a V-type engine characterized by the constituent requirements a), c), d), e), f) and g') of the fourth aspect.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS (First Embodiment)

FIGS. 1 to 8 show a first embodiment of a vehicle engine according to the present invention. One embodiment of the present invention will be described with reference to the figures.

Figure 1:
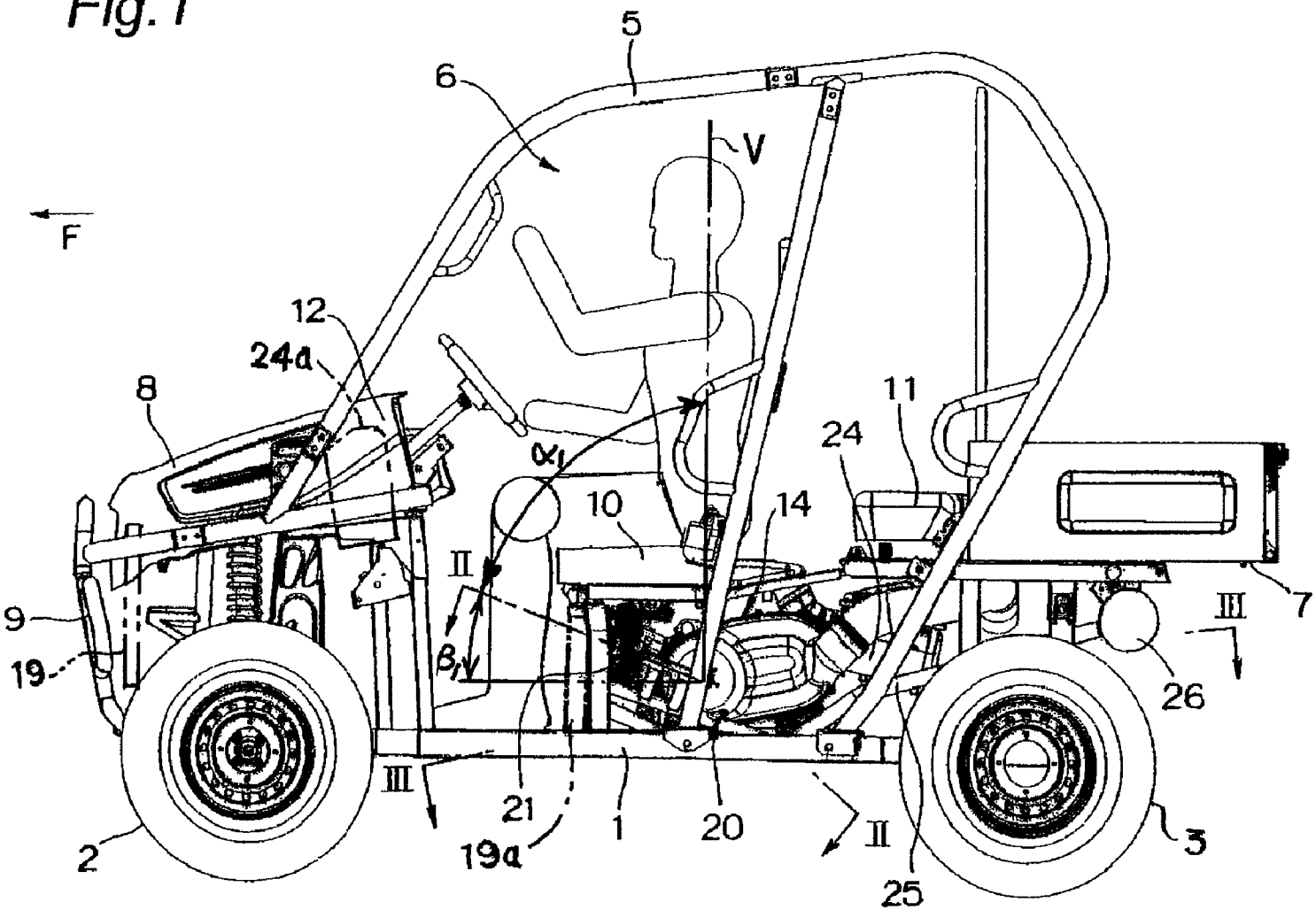
FIG. 1 is a partially cut left side view showing a four-wheeled vehicle provided with a vehicle engine according to one embodiment of the present invention.

FIG. 1 is a partially cut left side view showing a small-sized four-wheeled vehicle for irregular terrain (so-called utility vehicle) provided with a vehicle engine according to the present invention. In FIG. 1, the four-wheeled vehicle is provided with a pair of left and right front wheels 2 in a front part of a vehicle frame 1, a pair of left and right rear wheels 3 in a rear part of the vehicle frame 1, a cabin 6 surrounded by a cabin frame 5 between the front wheels 2 and the rear wheels 3, a loading platform 7 on the rear side of the cabin 6, a bonnet 8, a bumper 9 and the like on the front side of the cabin 6, and fenders (not shown) respectively on the upper side of the front wheels 2 and the rear wheels 3.

A front seat 10 formed in a bench shape is installed in a front half part in the cabin 6, a rear seat 11 formed in a folding-type bench shape is installed in a rear half part in the cabin 6, and a dashboard (operation portion) 12 is provided in a front end of the cabin 6. It should be noted that the front and rear seats 10 and 11 are not limited to seats in a bench shape but separate-type box seats may be installed.

An engine room 14 is formed so as to extend from lower space of the front seat 10 to lower space of the rear seat 11 and also positioned in a substantially center part of the vehicle in a width direction. An engine 20 is housed in this engine room 14 and supported on the vehicle frame 1. The engine 20 is a single-cylinder engine and has a single cylinder 21 which is inclined forward. Particularly, in order to reduce a total height of the engine 20, an inclination angle $\alpha 1$ of the cylinder 21 is set to be substantially 60° or more relative to a vertical direction. In this embodiment, the cylinder 21 is inclined forward by $\alpha$=70°. A radiator 19 is arranged in the bonnet 8 on the front side of the vehicle frame 1. It should be noted that there is sometimes a case where a radiator 19*a* may be arranged on the front side of the engine 20 as shown by an imaginary line.

An air intake device such as an air cleaner 24 for the engine is arranged in space on the rear side of the engine 20. An exhaust pipe 25 connected to an exhaust port (not shown) of the engine 20 extends rearward and is connected to an exhaust muffler 26 arranged on the lower side of the loading platform 7. It should be noted that there is sometimes a case where an air cleaner 24*a* may be arranged in the bonnet 8 on a front side of a steering wheel as shown by an imaginary line. In this case, the air cleaner 24*a* is connected to an air intake route of the engine in the engine room 14 via a passage (not shown).

Figure 2:
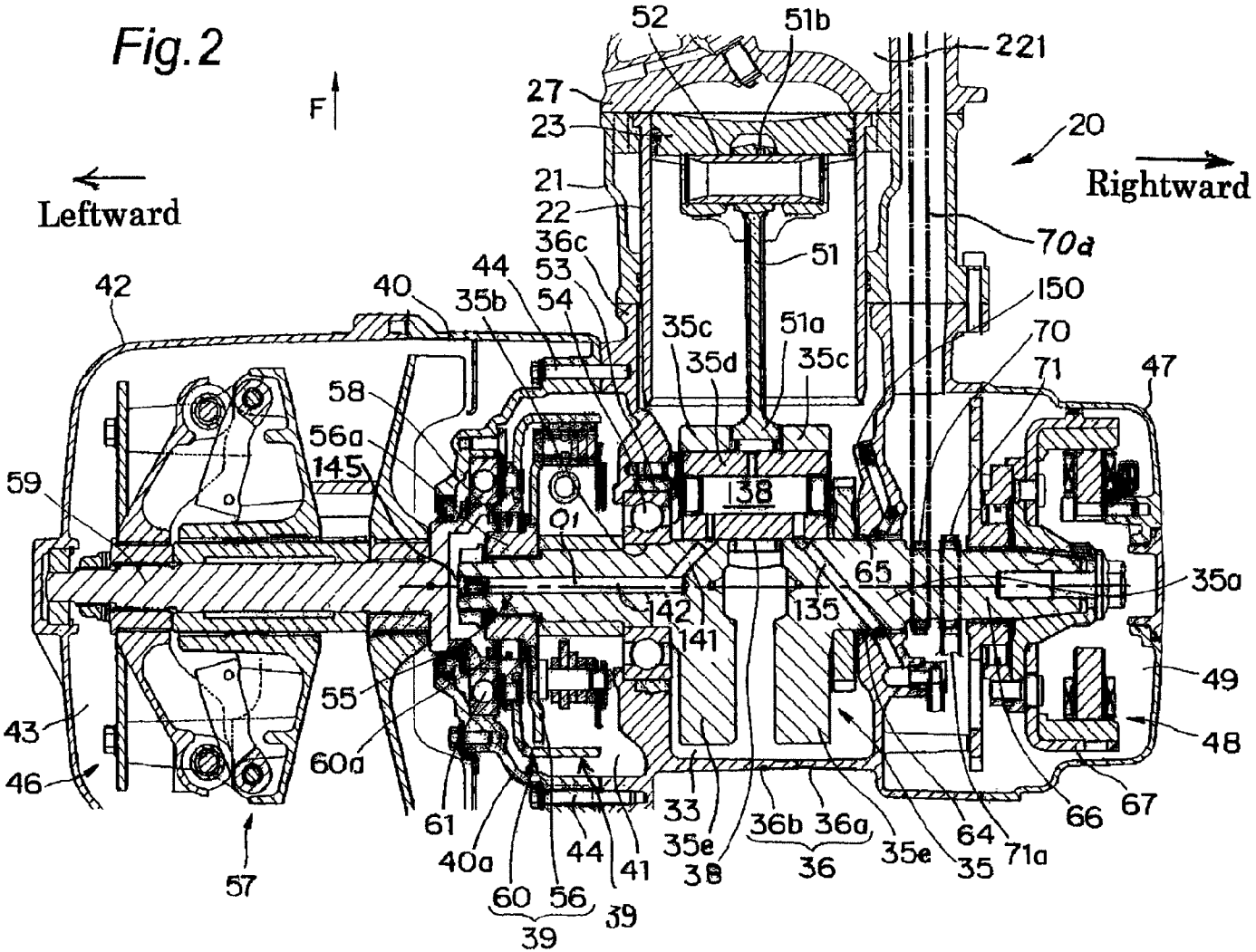
FIG. 2 is an enlarged sectional view taken along line II-II of the engine in FIG. 1.

FIG. 2 is an enlarged sectional view taken along line II-II of the engine 20 in FIG. 1. In FIG. 2, a cylindrical cylinder liner 22 is provided in the cylinder 21, and a piston 23 is slidably fitted to an inner peripheral surface of the cylinder liner 22.

A crankshaft 35 is housed in a crank chamber 33 of a crank case 36. The crank case 36 is divided into a right crank case member 36*a* and a left crank case member 36*b*. Both the crank case members 36*a* and 36*b* are coupled with each other in a substantially center part of the engine 20 in the crankshaft direction (left and right direction). The cylinder 21 is coupled with a bore portion 36*c* formed in a front upper end of the crank case 36.

Figure 3:
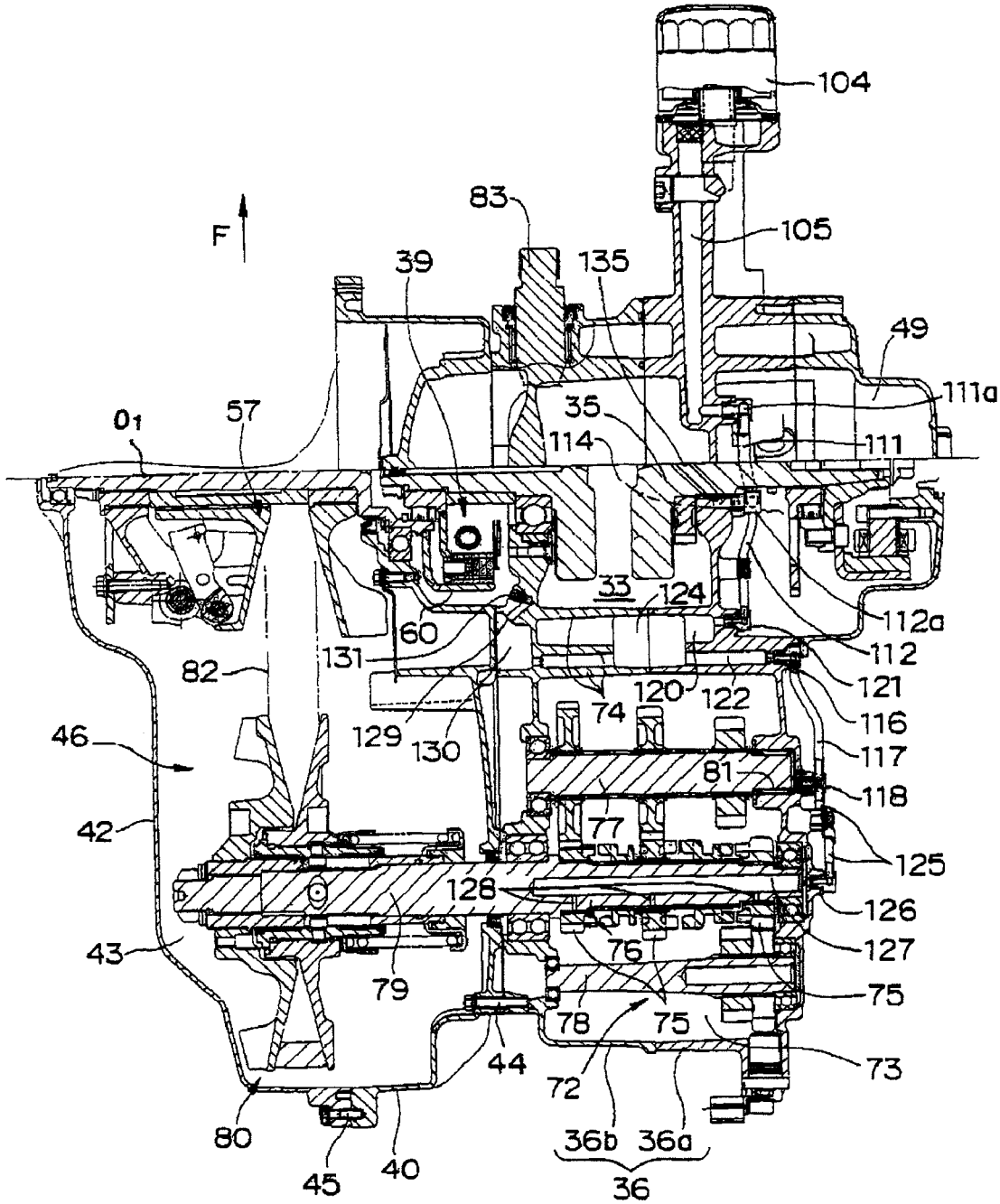
FIG. 3 is an enlarged sectional view taken along line of the engine in FIG. 1, and an internal structure is schematically shown in an upper part of FIG. 3.

A belt converter case 40 integrally provided with a clutch cover 40*a* is coupled with a left end surface of the left crank case member 36*b* by a plurality of bolts 44. A clutch chamber 41 for housing a centrifugal clutch 39 is formed by the clutch cover 40*a* and the left crank case member 36*b*. A belt converter cover 42 is coupled with a left end surface of the belt converter case 40 by a plurality of bolts 45 (FIG. 3). A belt converter chamber 43 for housing a belt converter (V-belt type continuously variable transmission) 46 is formed by the belt converter case 40 and the belt converter cover 42.

A generator cover (rotor housing chamber cover) 47 is coupled with a right end surface of the right crank case member 36*a* by a plurality of bolts (not shown). A generator chamber (one example of rotor housing chamber) 49 for housing a generator 48 is formed by the right crank case member 36*a* and the generator cover 47.

The crankshaft 35 has a right journal portion 35*a* and a left journal portion 35*b* positioned spaced apart in the crankshaft direction, a pair of crank arms 35*c* formed between both the journal portions 35*a* and 35*b*, a crank pin 35*d* for coupling both the crank arms 35*c*, weight portions 35*e* of the crank arms 35*c*. The crank pin 35*d* is fitted to an inner peripheral surface of a large end 51*a* of a connecting rod 51 through a plurality of roller bearings (or bearing metals) 38. The connecting rod 51 extends in the cylinder liner 22, and a small end 51*b* of the connecting rod 51 is coupled to the piston 23 through a piston pin 52.

Figure 4:
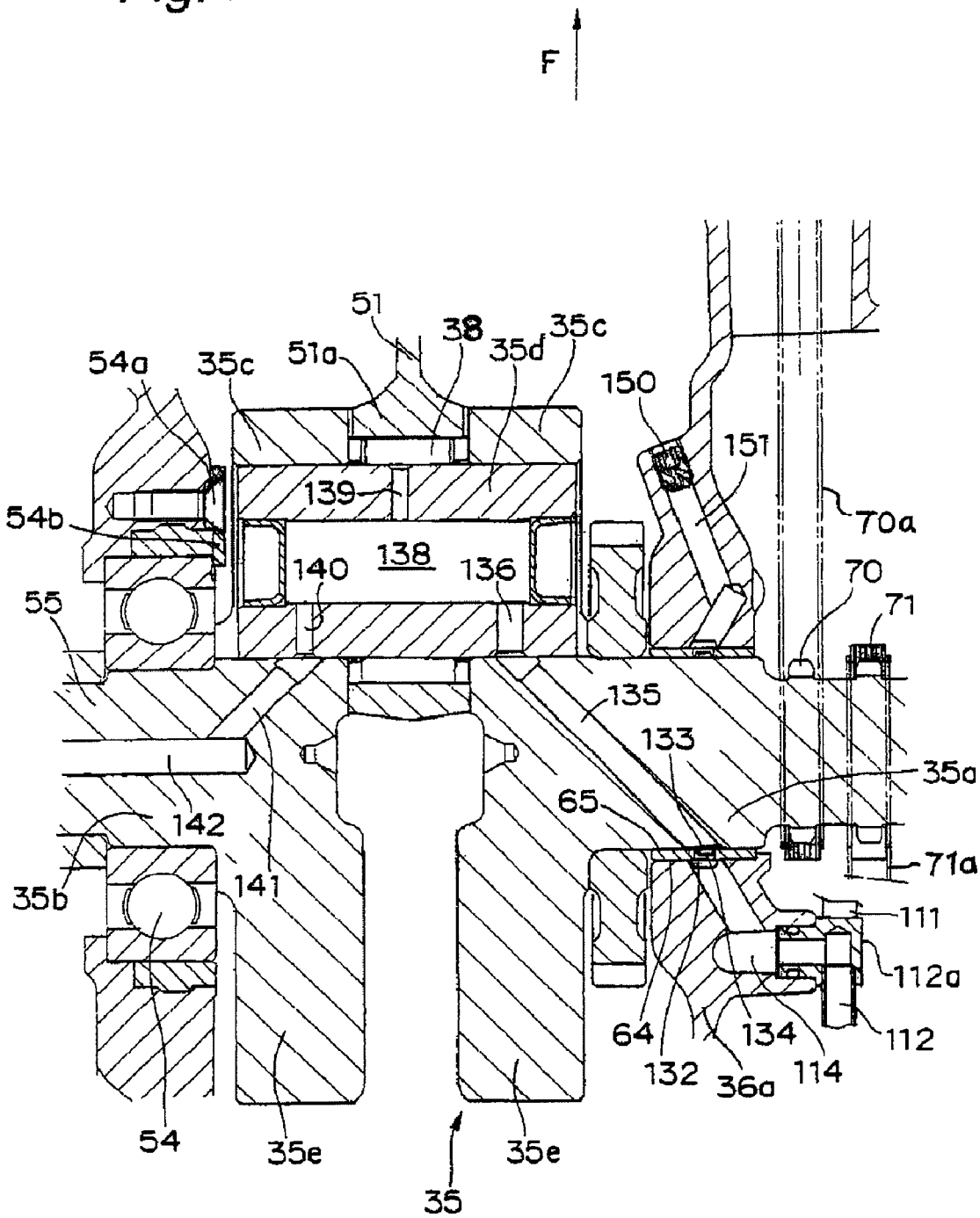
FIG. 4 is an enlarged sectional view of a crankshaft of the engine in FIG. 1.

The left journal portion 35*b* of the crankshaft 35 is rotatably fitted into a bearing hole 53 formed in the left crank case member 36*b* through a ball bearing 54. As shown in FIG. 4, the ball bearing 54 is engaged in the shaft direction by an engagement member 54*b* fixed by a bolt 54*a*. In FIG. 2, a clutch shaft 55 protruding into the clutch chamber 41 is integrally formed in the left journal portion 35*b*. A boss portion 56*a* of an inner member 56 of the centrifugal clutch 39 is splined to an outer peripheral surface of the clutch shaft 55 so as to be rotated integrally with the clutch shaft 55. A boss portion 60*a* of a clutch housing 60 is fitted to an outer peripheral surface of the boss portion 56*a* via a one-way clutch 58. The boss portion 60*a* is formed integrally with a drive shaft 59 of the belt converter 46 and rotatably fitted to an inner peripheral surface of the clutch cover 40*a* through a ball bearing 61.

The drive shaft 59 of the belt converter 46 protrudes into the belt converter chamber 43, and a drive pulley 57 of the belt converter 46 is attached to an outer peripheral surface of the drive shaft 59.

The right journal portion 35*a* of the crankshaft 35 is rotatably fitted to an inner peripheral surface of a bearing hole 64 formed in the right crank case member 36*a* through a bearing metal 65. A generator shaft 66 protruding into the generator chamber 49 is integrally formed in the right journal portion 35*a*, and a rotor 67 of the generator 48 is fixed to the generator shaft 66.

A cam driving chain sprocket (chain gear) 70 and a pump driving chain sprocket (chain gear) 71 are further formed in the generator shaft 66. A cam chain 70*a* is wound around the cam driving chain sprocket 70, and a pump driving chain 71*a* is wound around the pump driving chain sprocket 71.

Figure 7:
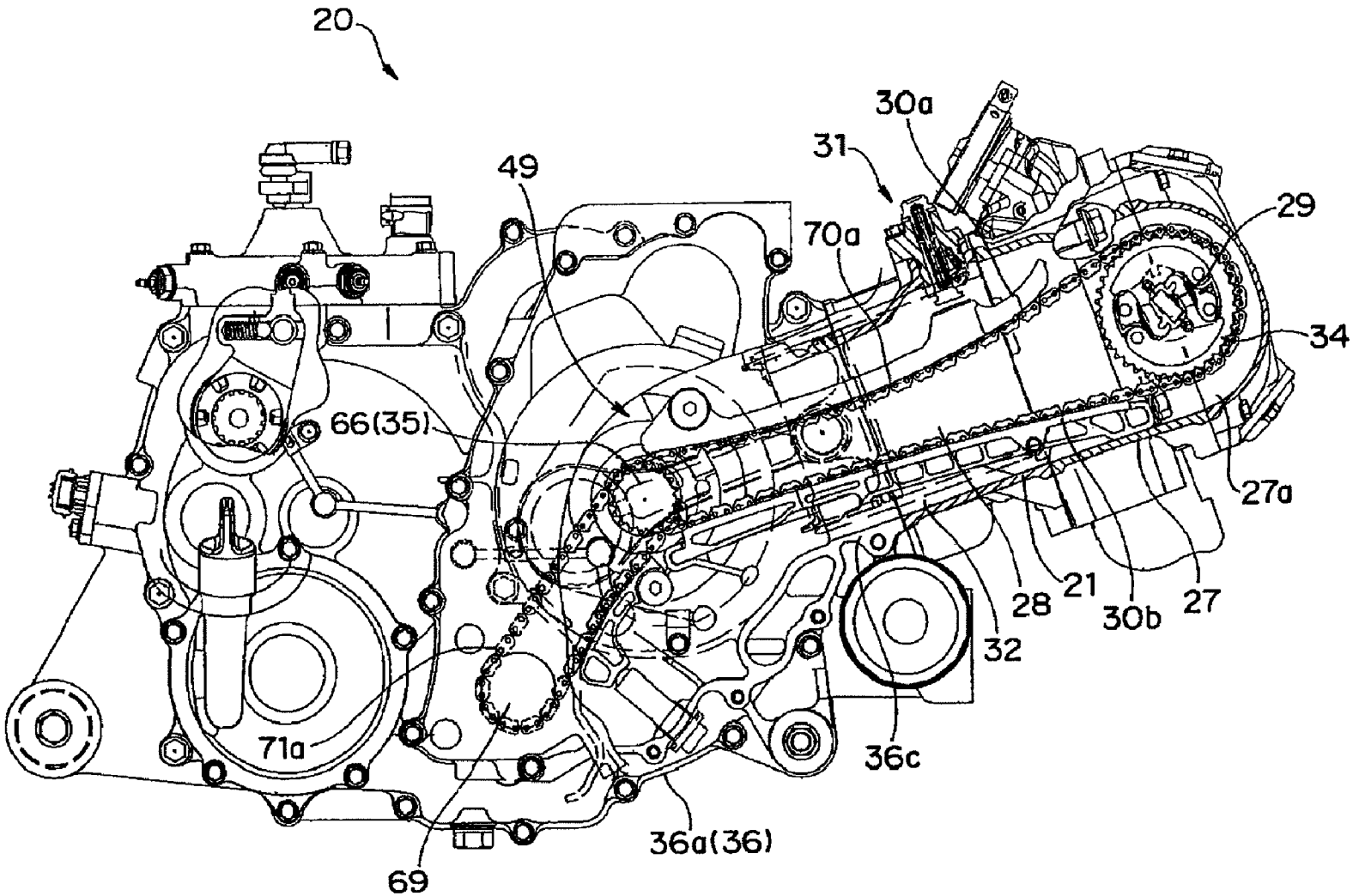
FIG. 7 is a partially cut right side view of the engine in FIG. 1.

FIG. 7 is a partially cut right side view of the engine 20 in FIG. 1. In a right end part of the bore portion 36*c* of the right crank case member 36*a*, a right end part of the cylinder 21 and a right end part of a cylinder head 27, a cam chain tunnel 28 is formed so as to extend from a rocker arm chamber 27*a* on a front surface of the cylinder head 27 to the generator chamber 49. The cam chain 70*a* extends from the generator chamber 49 to the rocker arm chamber 27*a* via the cam chain tunnel 28. A front end of the cam chain 70*a* is wound around a sprocket 34 of a cam shaft 29 for driving air intake and exhaust valves provided in a front surface part of the cylinder head 27.

FIG. 3 is an enlarged sectional view taken along line III-III in FIG. 1. An internal structure is schematically shown in a part on the upper side of a crankshaft center O1 in the figure. In FIG. 3, a transmission chamber 73 for housing a gear-type transmission 72 is formed in a rear part of the crank case 36, and the transmission chamber 73 and the crank chamber 33 on the front side are separated from each other by a partition wall 74. The gear-type transmission 72 is provided with a transmission input shaft 76, a counter shaft 77, a rearward idling shaft 78 and an output shaft (not shown) in parallel to the crankshaft 35. As well as a known gear-type transmission, transmission gears provided in the shafts 76, 77 and 78 are meshed with each other and meshing rows of the gears are selected so as to change speed. It should be noted that the output shaft 78 has a gear meshing with an output gear of the counter shaft 77. Mechanical power is transmitted from the output shaft 78 to the front wheels 2 and the rear wheels 3 (FIG. 1) via a bevel gear mechanism (not shown), a two/four-wheel drive mode switching device (not shown), a forward drive shaft 83, a rearward drive shaft (not shown) and the like.

A driven shaft 79 for the belt converter protruding into the belt converter chamber 43 is integrally formed in a left end of the input shaft 76 of the gear-type transmission 72. A driven pulley 80 of the belt converter 46 is attached to the driven shaft 79. A V-belt 82 is looped over the driven pulley 80 and the drive pulley 57.

(Configuration of Oil Circulation Route)

Figure 5:
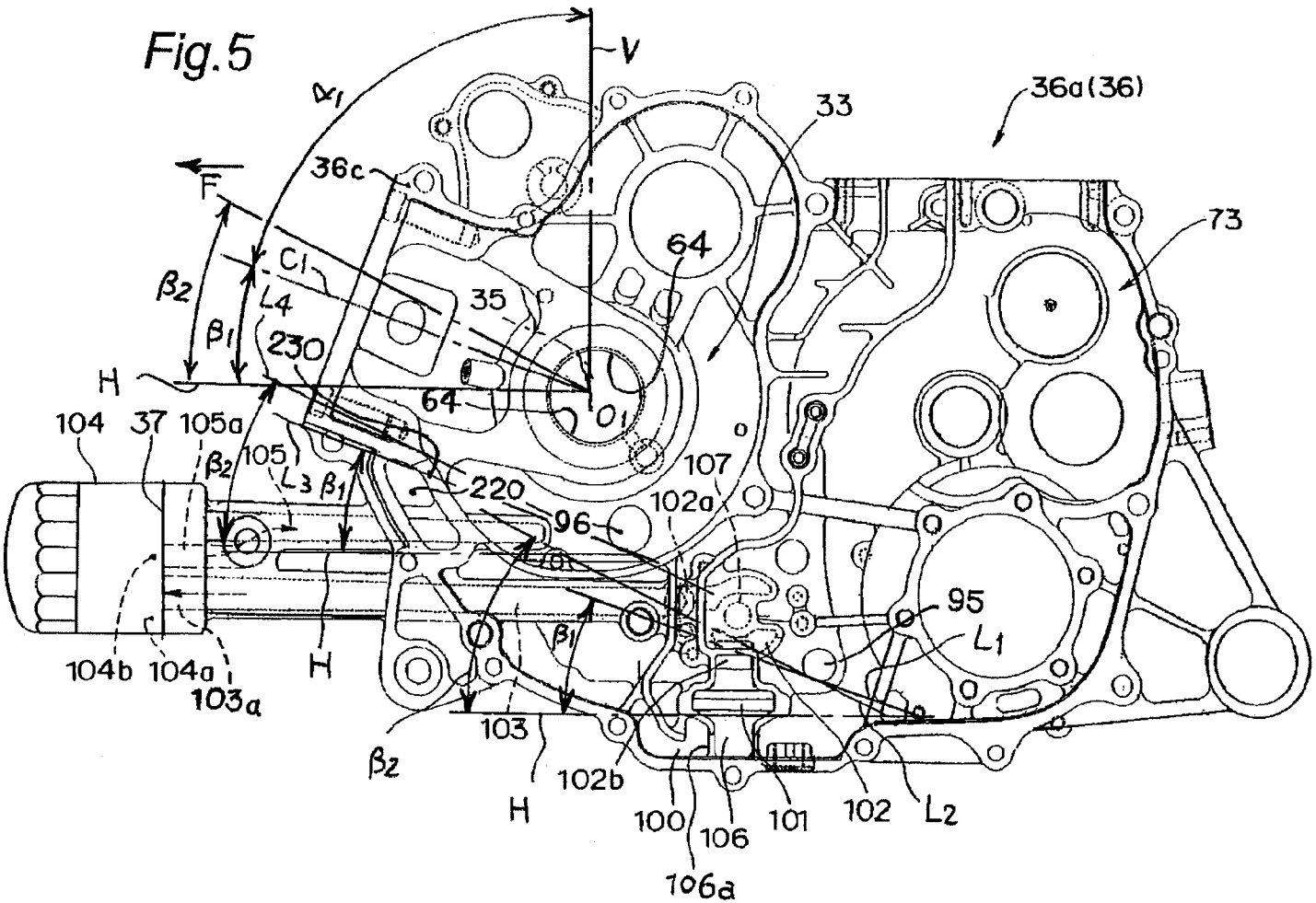
FIG. 5 is a left side view (inner side view) of a right crank case member of the engine in FIG. 1.

FIG. 5 is a left side view (inner side view) of the right crank case member 36*a*. An oil circulation route of the engine includes a main oil route extending from an oil pan 100 of the transmission chamber 73 to the bearing hole 64 for the crankshaft via a secondary oil filter 104, a plurality of sub oil routes extending from the main oil route to oil feeding points in the engine, and a plurality of oil return routes returning from the oil feeding points to the oil pan 100 of the transmission chamber 73. Although described in detail later, the sub oil routes include a sub oil route for supplying oil to the crank pin 35*d* of the crankshaft 35, the centrifugal clutch 39 and the like shown in FIG. 2, a sub oil route for supplying oil to the piston 23, a sub oil route for supplying oil to the gear-type transmission 72 shown in FIG. 3, a sub oil route for supplying oil to the cam shaft 29 shown in FIG. 7 and a rocker arm and the like (not shown), and other sub oil routes.

The main oil route will be described. In FIG. 5, the main oil route includes the oil pan 100, an oil suction passage 106 having an oil intake port 106*a* opened in the oil pan 100 and extending upward, an oil pump 102 communicating with an upper end of the oil suction passage 106, a first main oil passage 103 communicating with a discharge portion 102*a* of the oil pump 102 and extending forward in the right crank case member 36*a*, the secondary oil filter 104 attached to a front end surface 37 of the right crank case member 36*a*, a second main oil passage 105 extending rearward in the right crank case member 36*a* from the secondary oil filter 104 to a position in proximity to the bearing hole 64 for the crankshaft, and other oil passages and the like. An upper end of the oil suction passage 106 communicates with a suction portion 102*b* of the oil pump 102.

The oil pan 100 is positioned in a front lower end of the transmission chamber 73. The second main oil passage 105 is arranged on the upper side of the first main oil passage 103 and extends substantially in parallel to the first main oil passage 103. A front end 103*a* of the first main oil passage 103 communicates with an oil inlet 104*a* of the secondary oil filter 104. An oil outlet 104*b* of the secondary oil filter 104 communicates with a front end 105*a* of the second main oil passage 105. A plate-shape primary oil filter 101 is arranged in the middle of the oil suction passage 106.

Figure 6:
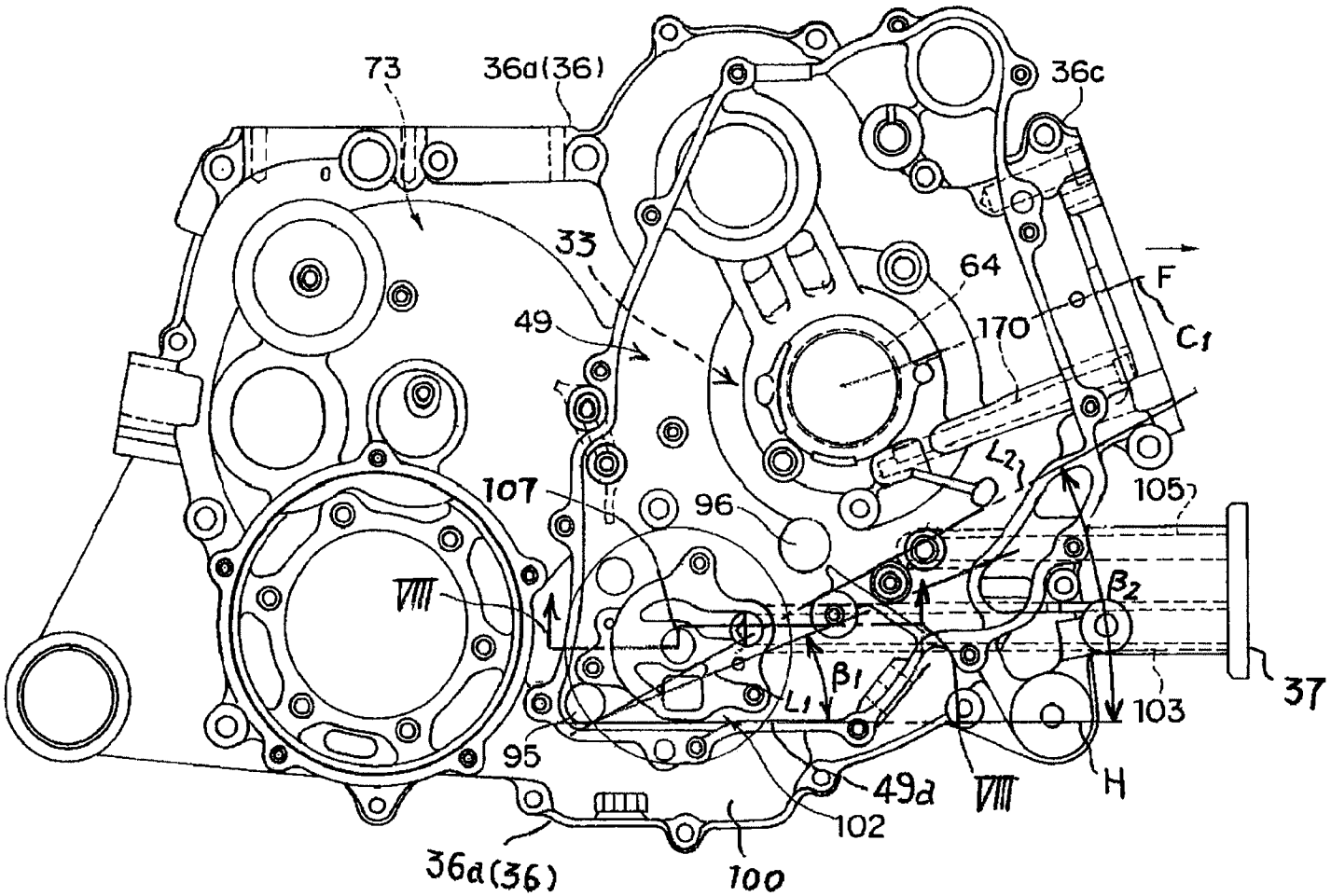
FIG. 6 is a right side view (outer side view) of the right crank case member of the engine in FIG. 1.
Figure 8:
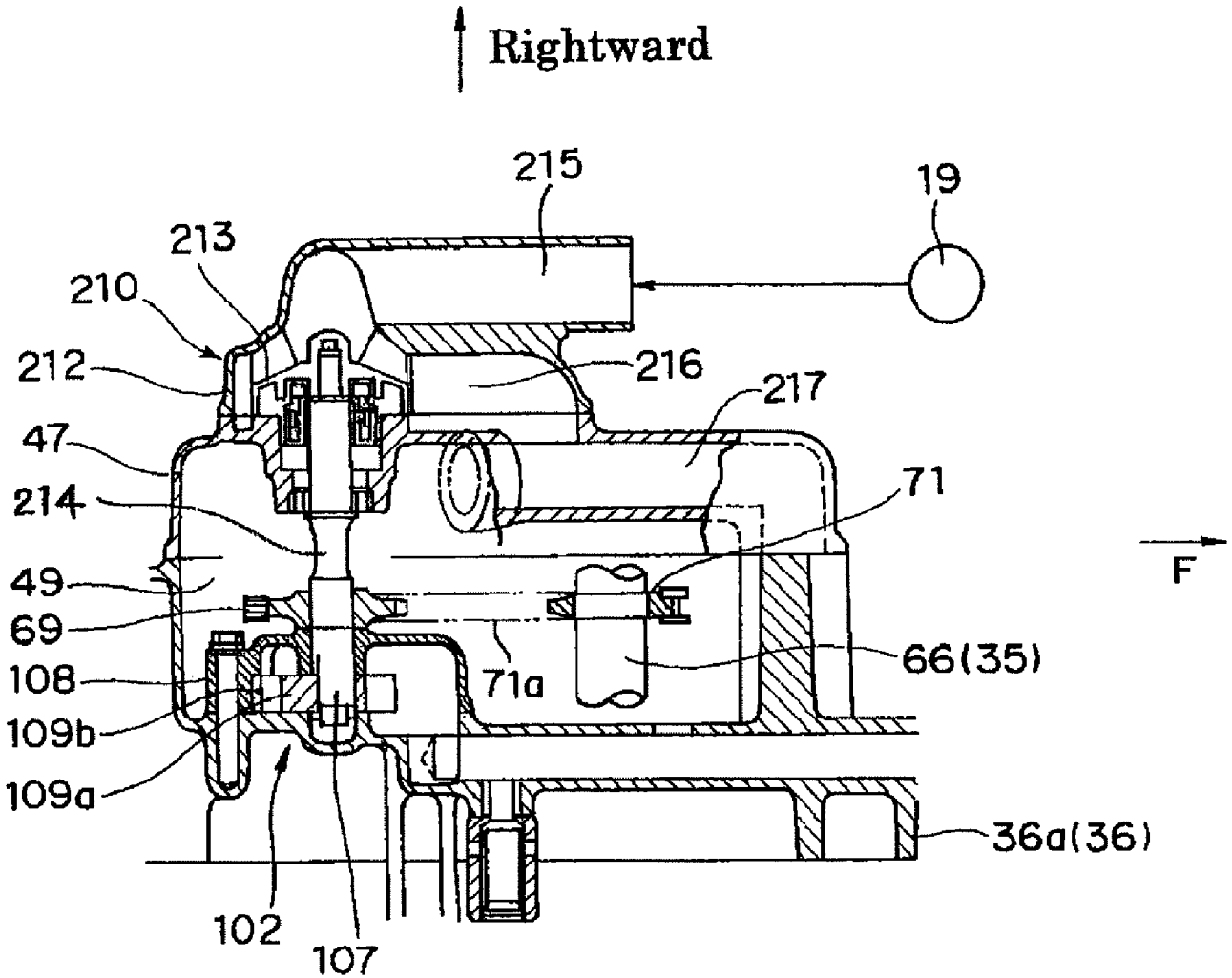
FIG. 8 is a sectional view taken along line VIII-VIII in FIG. 6.

FIG. 8 is a sectional view taken along line VIII-VIII in FIG. 6 (view seen from the lower side). The oil pump 102 is for example a trochoid pump provided with a pump casing 108 attached to a right end of the right crank case member 36*a*, inner and outer toothed rotors 109*a* and 109*b* arranged in the casing 108, and an oil pump shaft 107 to which the inner rotor 109*a* is fixed. A sprocket 69 provided in the pump shaft 107 is coupled to the pump driving chain sprocket 71 of the generator shaft 66 via the pump driving chain 71*a* so as to transmit the mechanical power.

It should be noted that a water pump casing 212 is attached to the generator cover 47, and a water pump 210 is provided in the water pump casing 212. A pump shaft 214 to which an impeller 213 of the water pump 210 is fixed is formed coaxially and integrally with the pump shaft 107 of the oil pump 102. The mechanical power is transmitted via the sprocket 69 and the driving chain 71*a*. The pump casing 212 has a suction passage 215 and a discharge passage 216. The suction passage 215 communicates with a coolant outlet of the radiator 19, and the discharge passage 216 communicates with a coolant passage 217 in the generator cover 47.

In FIG. 3, a front end of a first oil pipe (main oil pipe) 111 arranged in the generator chamber 49 is connected to a rear end of the second main oil passage 105 through a first oil joint 111*a*. This first oil pipe 111 extends rearward in the generator chamber 49 to a position on the substantially lower side of the crankshaft 35, and as shown in FIG. 4, communicates with an oil passage 114 formed in a wall of the right crank case member 36*a* through a second oil joint 112*a*. This oil passage 114 communicates with a right oil passage (upstream oil passage) 135 in the crankshaft 35.

One of the sub oil routes for cooling the centrifugal clutch will be described. In FIG. 3, a second oil pipe 112 extending further rearward is connected to the second oil joint 112*a*. A rear end of the second oil pipe 112 is connected to an oil passage 120 formed in the partition wall 74 between the crank chamber 33 and the transmission chamber 73 through an oil joint 121.

In the partition wall 74, a rear oil passage 122 is further formed at a position on the rear upper side of the oil passage 120. The rear oil passage 122 communicates with the oil passage 120 on the front side via a communication chamber 124 in the partition wall 74 and extends in the left and right direction substantially in parallel to the crankshaft 35.

A left end of the rear oil passage 122 communicates with an oil nozzle 131 for cooling the centrifugal clutch via an oil chamber 130 formed in the left crank case member 36*b* and an oil passage 129. Meanwhile, a right end of the rear oil passage 122 communicates with the sub oil route for supplying the oil to the gear-type transmission 72.

The sub oil route for the gear-type transmission will be described. In FIG. 3, the right end of the rear oil passage 122 in the partition wall 74 is connected to an external third oil pipe 117 through a fourth oil joint 116. The third oil pipe 117 extends rearward and communicates with a fifth oil joint 118 attached to a right wall of the transmission chamber 73 (right wall of the right crank case member 36*a*). This fifth oil joint 118 communicates with a needle bearing 81 of the counter shaft 77 of the gear-type transmission 72. Further, a fourth oil pipe 125 and the like extending rearward are connected to the fifth oil joint 118. A rear end of the fourth oil pipe 125 communicates with a sixth oil joint 126 attached to the right wall of the transmission chamber 73 (right wall of the right crank case member 36*a*). This sixth oil joint 126 communicates with an oil passage 127 formed in the input shaft 76 of the gear-type transmission 72. The oil passage 127 extends leftward in the input shaft 76. The oil passage 127 communicates with a plurality of branch passages 128 extending in a radial direction. The branch passages 128 communicate with fitting parts of a transmission gear 75 on the input shaft 76.

The sub oil route in the crankshaft 35, another sub oil route for the centrifugal clutch and the sub oil route for the piston will be described. In FIG. 4, the oil passage 114 in the right crank case member 36*a* communicating with the second oil joint 112*a* extends upward and communicates with a circular oil passage 132 formed in the inner peripheral surface of the bearing hole 64 of the right crank case member 36*a*. The circular oil passage 132 communicates with the right oil passage 135 in the crankshaft 35 via an oil hole or opening 134 in the radial direction formed in the bearing metal 65 and a circular groove 133 formed in the inner peripheral surface of the bearing metal 65.

The right oil passage 135 in the crankshaft 35 extends toward the crank pin 35*d* and communicates with a fitting part between the large end 51*a* of the connecting rod 51 and the crank pin 35*d* (part in which the roller bearings 38 are arranged) via a right oil hole or opening 136 formed in a right part of the crank pin 35*d*, an oil chamber 138 in the crank pin 35*d* and an intermediate oil hole or opening 139 formed in a center part of the crank pin 35*d* in the shaft direction.

The oil chamber 138 in the crank pin 35*d* further communicates with a left oil passage 141 in the crankshaft 35 via a left oil hole or opening 140 formed on the left side of the crank pin 35*d*. This left oil passage 141 further communicates with a centrifugal clutch oil passage 142 formed in a shaft center part of the crankshaft 35. In FIG. 2, a first oil nozzle 145 provided in a left end of the centrifugal clutch oil passage 142 sprays the oil toward an end surface (right end surface of the drive shaft 59) of the boss portion 60*a* of the clutch housing 60 of the centrifugal clutch 39.

The sub oil route for the cam shaft will be described. In FIG. 4, the circular oil passage 132 of the bearing hole 64 communicates with a piston cooling oil passage 151 extending to a piston cooling oil nozzle 150, and also communicates with a cam shaft feeding oil passage 170 formed in the right crank case member 36*a* as shown in FIG. 6. The cam shaft feeding oil passage 170 extends to a front end of the bore portion 36*c* of the right crank case member 36*a* and communicates with an oil feeding part of the cam shaft 29 shown in FIG. 7 via an oil pipe and an oil passage (not shown) so as to feed the oil to the cam shaft 29.

The oil return route returning from the cylinder head 27 will be described. In FIG. 7, the cam chain 70*a*, an upper chain guide 30*a* for guiding an upper edge of the cam chain 70*a* and a lower chain guide 30*b* for guiding a lower edge of the cam chain 70*a* are arranged in the cam chain tunnel 28. A cam chain tensioner 31 is provided in the upper chain guide 30*a*. The lower chain guide 30*b* is arranged on the upper side of a bottom surface of the cam chain tunnel 28 by a predetermined distance. Thereby, a returning oil passage 32 is provided in a lower end of the cam chain tunnel 28. That is, this returning oil passage 32 extends rearward along the bottom surface of the cam chain tunnel 28 from the rocker arm chamber 27*a* in the front surface part of the cylinder head 27 to the generator chamber 49.

(Detailed Structure of Generator Chamber 49)

In FIG. 6, the generator chamber 49 spreads so as to occupy a majority of a front half part of the crank case 36 seen from the side. A bottom wall 49*a* of the generator chamber 49 is substantially horizontally formed at a position higher than a bottom surface of the oil pan 100 and substantially corresponding to a lower end of the oil pump 102.

A first oil communication hole or opening 96 providing communication between the generator chamber 49 and the crank chamber 33 (FIG. 2) is opened in a wall part of the right crank case member 36*a* between the generator chamber 49 and the crank chamber 33 (FIG. 2) at a substantially middle position between the bearing hole 64 for the crankshaft and the oil pump 102 seen from the side. Further, a second oil communication hole or opening 95 providing communication between the transmission chamber 73 and the generator chamber 49 is opened in the wall part of the right crank case member 36*a* at a position substantially corresponding to a rear lower end of the generator chamber 49. Part of the oil in the crank chamber 33 is discharged (returned) to the oil pan 100 of the transmission chamber 73 via the generator chamber 49 by utilizing the first oil communication hole or opening 96 and the second oil communication hole or opening 95.

Positions of the first oil communication hole or opening 96 and the second oil communication hole or opening 95 will be described in detail. As described above, the second oil communication hole or opening 95 is arranged at the position substantially corresponding to the rear lower end of the generator chamber 49. As shown in FIG. 5, the second oil communication hole or opening 95 is also positioned on the upper side of an upper edge of the oil intake port 106*a* of the oil pump 102 where the oil remains at least in the entire area of the oil pan 100 when the vehicle is inclined forward by an angle substantially corresponding to a complementary angle β1 of the inclination angle α1 of the cylinder relative to the substantially horizontal direction.

In this embodiment, the inclination angle α1 of a center line C1 of the cylinder relative to the vertical direction (vertical line V) is set to be 70°, and the complementary angle β1 thereof is substantially 20°. Therefore, the position of the second oil communication hole or opening 95 is set so that even when the vehicle is inclined forward by an angle corresponding to the complementary angle β1 (=substantially)20° relative to the substantially horizontal direction (horizontal line H) and hence the oil flows back from the transmission chamber 73 to the generator chamber 49 (FIG. 6) via the second oil communication hole or opening 95, at least a minimum oil level L1 is maintained in the transmission chamber 73. Thereby, the oil in the oil pan 100 remains at least in the entire area of the oil pan 100 in the transmission chamber 73.

It should be noted that an oil level L2 indicates a minimum oil level in the generator chamber 49 when the vehicle is inclined forward by substantially 30° (angle β2) relative to the substantially horizontal direction (horizontal line H). In this embodiment, even when the vehicle is inclined forward by the angle β2, the oil remains at least in the entire area of the oil pan 100.

In FIG. 5, the first oil communication hole or opening 96 is positioned in proximity to a lower wall of the crank chamber 33 and in a fore aft direction, slightly on the rear side of the crankshaft center O1. Further, the first oil communication hole or opening 96 is positioned on the lower side of a lower end of the bore portion 36*c* in a front end of the crank case 36 and on the upper side of an upper end of the oil pump 102.

By setting the first oil communication hole or opening 96 at the above position, when the vehicle is inclined forward by the predetermined angle β1 relative to the substantially horizontal direction as described above, the oil in the crank chamber 33 reaches an oil level L3 so that the oil does not flow out from the crank chamber 33 into the cylinder 21. Further, as described above, even when the vehicle is largely inclined by the inclination angle β2 (substantially 30°), the oil in the crank chamber 33 hardly flows out into the cylinder 21.

(Operation)

A flow of the oil in the oil circulation route will be briefly described. In FIG. 5, the oil in the oil pan 100 is suctioned from the oil suction portion 102*b* into the oil pump 102 via the oil intake port 106*a*, the oil passage 106 and the primary oil filter 101, discharged from the discharge portion 102*a* into the first main oil passage 103, and pressure-fed in the first main oil passage 103 to the front end surface 37 of the crank case 36.

The oil supplied from the front end 103*a* of the first main oil passage 103 to the secondary oil filter 104 via the oil inlet 104*a* is filtered, supplied to the second main oil passage 105 via the oil outlet 104*b*, and pressure-fed in the second main oil passage 105 to a position on the lower side of the bearing hole 64 for the crankshaft.

As described above, from the rear end of the second main oil passage 105, the oil is respectively supplied to the sub oil route for supplying the oil to the crank pin 35*d* of the crankshaft 35, the centrifugal clutch 39 and the like shown in FIG. 2, the sub oil route for supplying the oil to the piston 23, the sub oil route for supplying the all to the gear-type transmission 72 shown in FIG. 3, the sub oil route for supplying the oil to the cam shaft 29 of the cylinder head 27 shown in FIG. 7 and the rocker arm and the like (not shown), and the other sub oil routes.

The oil supplied to the crank pin 35*d*, the piston 23 and the like in FIG. 2 flows down or falls down into the crank chamber 33, and is returned from the crank chamber 33 to the transmission chamber 73 (oil pan 100) via the first oil communication hole or opening 96, the generator chamber 49 and the second oil communication hole or opening 95 in FIG. 6. The oil supplied to the gear-type transmission in FIG. 3 is directly returned to the transmission chamber 73. The oil supplied to the cam shaft 29 and the like in FIG. 7 is discharged to the returning oil passage 32 in the cam chain tunnel 28, flows rearward in the returning oil passage 32, and then discharged to the generator chamber 49. The oil discharged to the generator chamber 49 is joined to the oil flowing from the crank chamber 33 and returned to the transmission chamber 73 via the second oil communication hole or opening 95.

In FIG. 5, in a case where the vehicle is inclined forward on a downward slope or the like at the time of driving the vehicle, part of the oil in the transmission chamber 73 flows back to the generator chamber 49 (FIG. 6) via the second oil communication hole or opening 95. However, the oil level in the transmission chamber 73 is suppressed to a position substantially in a lower end of the second oil communication hole or opening 95. That is, with the inclination angle β1 (20° of the vehicle, the oil is only reduced to the oil level L1, and with the inclination angle β2 (30° of the vehicle, the oil is only reduced to the oil level L2. In both cases, the oil remains at least in the entire area of the oil pan 100. Therefore, it is possible to suction and discharge the oil by the oil pump 102 without causing the air entrainment phenomenon so as to maintain a favorable oil circulation.

It should be noted that the oil pump shaft 107 is soaked in the oil when the engine is stopped in a horizontal state. However, since the oil level in the oil pan 100 is reduced at the time of operating the engine, the oil pump shaft 107 is not soaked in the oil. Since the oil pump shaft 107 has less resistance in this state of not soaked in the oil, an output loss is decreased so as to favorably operate the engine.

Further, in a case where the vehicle is inclined by the angle β1 or β2 as described above, the oil is moved forward in the crank chamber 33. However, movement of the oil is controlled so that the oil does not enter at least the cylinder 21. Therefore, an energy efficiency loss due to oil resistance received by the piston 23 is prevented.

(Second Embodiment)

Figure 9:
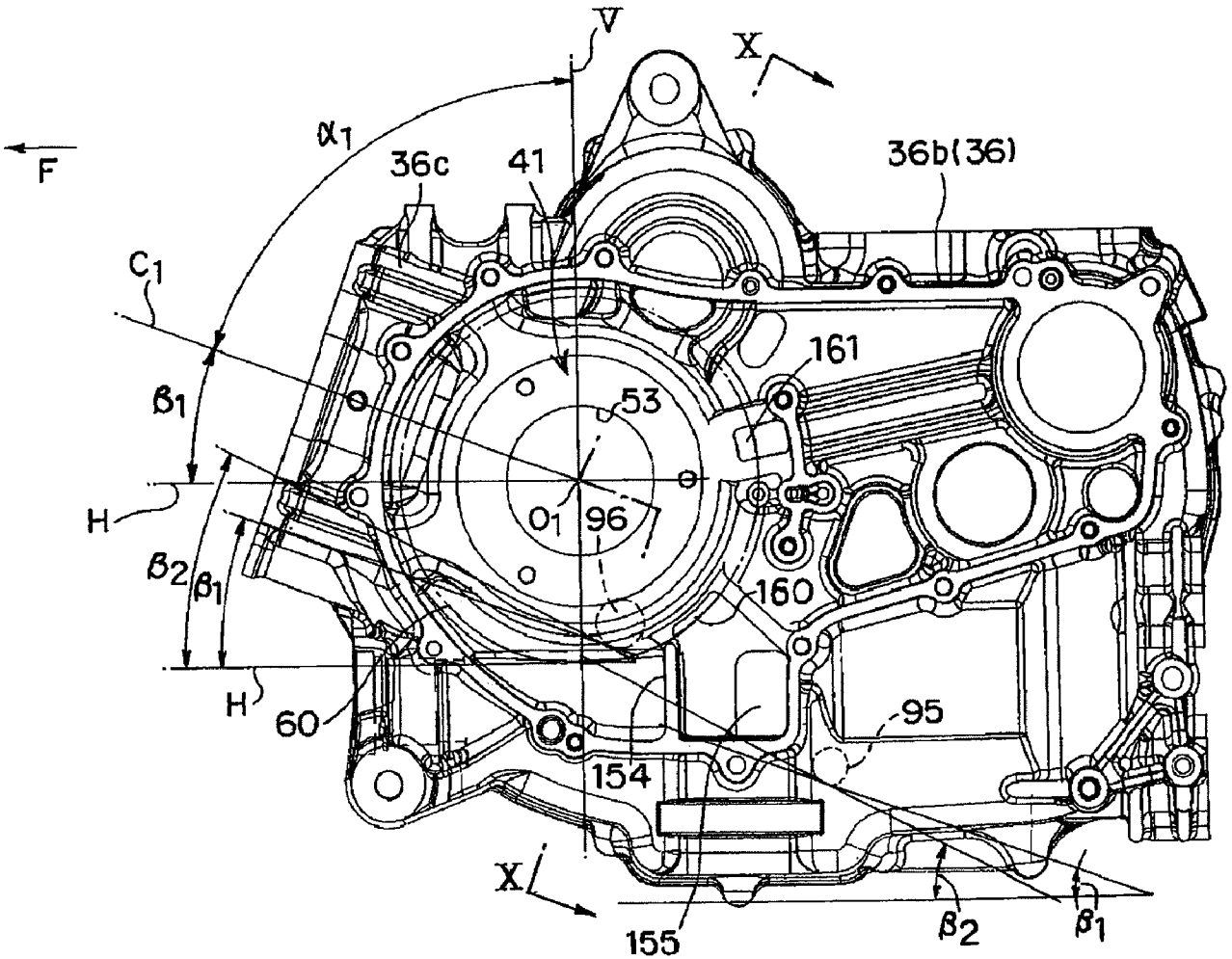
FIG. 9 is a left side view of a left crank case member according to another embodiment of the present invention.
Figure 10:
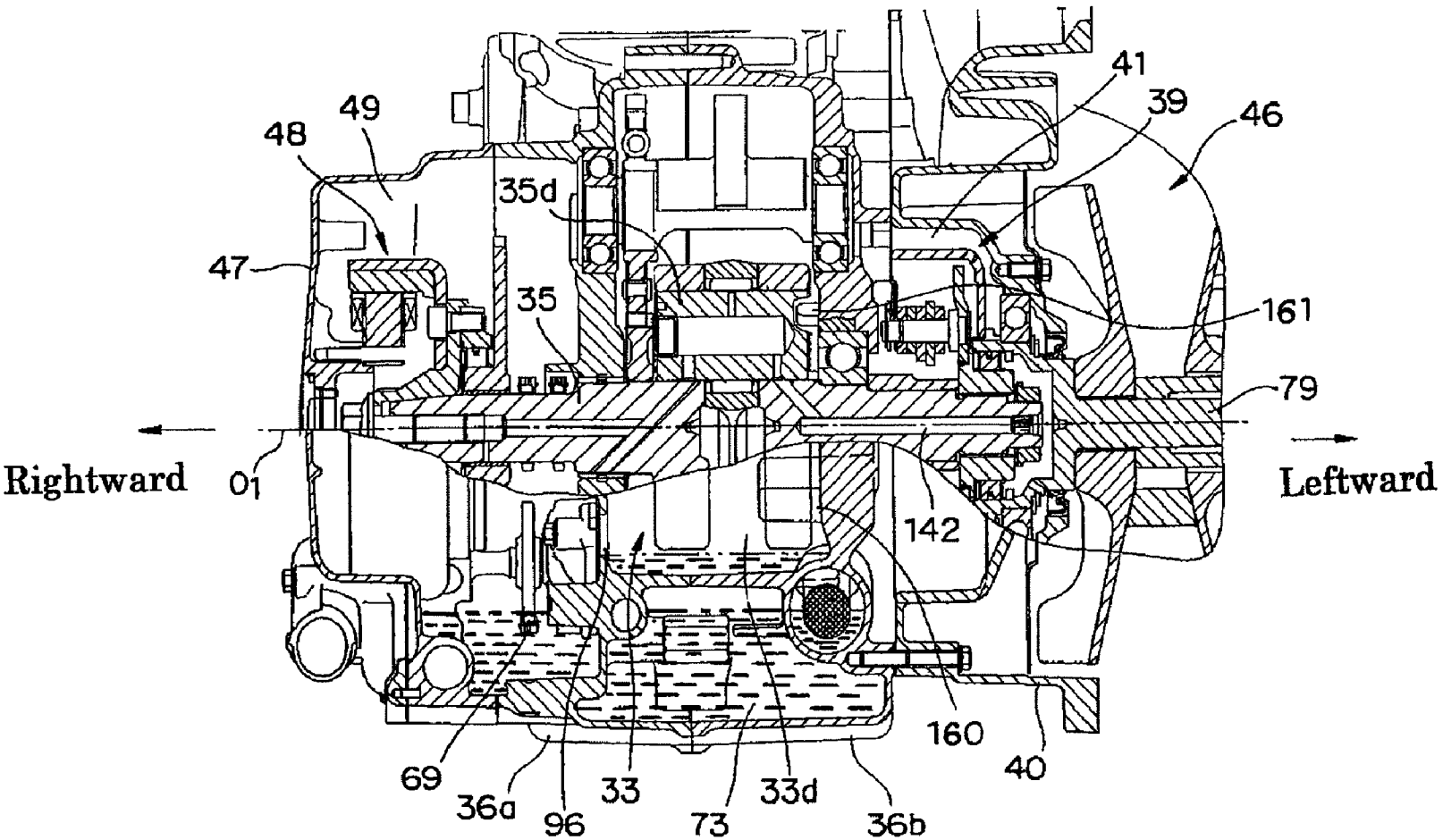
FIG. 10 is a sectional view taken along line X-X in FIG. 9.

FIGS. 9 and 10 show a second embodiment of the present invention. FIG. 9 is a left side view of the left crank case member 36*b*. A basic structure is the same as the first embodiment. In addition to this, an oil discharge hole or opening 160 and a ventilation hole or opening 161 are provided in a bottom wall 33*d* and a side wall of the crank chamber 33. It should be noted that the same parts and portions as the first embodiment are given the same reference symbols (numerals). An area in which cross-hatching is drawn in FIG. 10 indicates a section of the oil.

FIG. 9 is the left side view of the left crank case member 36*b*, and FIG. 10 is a sectional view taken along line X-X in FIG. 9. In FIG. 10, the oil discharge hole or opening 160 providing communication between the crank chamber 33 and the clutch chamber 41 is formed in a rear part of the bottom wall 33*d* of the crank chamber 33, and the ventilation hole or opening 161 providing communication between the crank chamber 33 and the clutch chamber 41 so as to distribute gas is formed in a left end of a rear wall of the crank chamber 33. The oil discharge hole or opening 160 is formed in a substantially left half of the bottom wall 33*d* of the crank chamber 33 (left crank case member 36*b*).

In FIG. 9, a dam 154 is formed in a bottom wall of the clutch chamber 41. The oil is gathered in a front part of this dam so that a lower end of the clutch housing 60 (imaginary line) of the centrifugal clutch 39 (FIG. 2) is dipped in the oil. A space part on the rear side of the dam 154 communicates with the transmission chamber 73 via a communication hole or opening 155. The oil discharge hole or opening 160 communicates with the space part on the rear side of the dam 154. The ventilation hole or opening 161 is formed at a position at least higher than the crankshaft center O1.

A basic operation relating to oil circulation is the same as the first embodiment and description thereof will not be given. In FIG. 10, part of the oil returning to the crank chamber 33 is discharged from the first oil communication hole or opening 96 to the generator chamber 49 at the time of driving the vehicle. In this embodiment, separately from oil discharge from the first oil communication hole or opening 96, the majority of the oil is actively discharged from the oil discharge hole or opening 160 of the bottom wall 33*d* of the crank chamber 33 into the clutch chamber 41 by utilizing rotation of the crankshaft 35. The oil discharged to the clutch chamber 41 is returned to the transmission chamber 73 via the communication hole or opening 155 of FIG. 9.

In the crank chamber 33, as described above, since the oil is discharged from the oil discharge hole or opening 160 by the rotation of the crankshaft 35 and the oil is discharged from the first oil communication hole or opening 96, internal pressure (atmospheric pressure) of the crank chamber 33 is radically changed. However, since the ventilation hole or opening 161 is formed, a pressure change in the crank chamber 33 can be suppressed. Thereby, it is possible to prevent a decrease in movement speed of the piston 23 (refer to FIG. 2) and rotation speed of the crankshaft 35.

(Third Embodiment)

Figure 11:
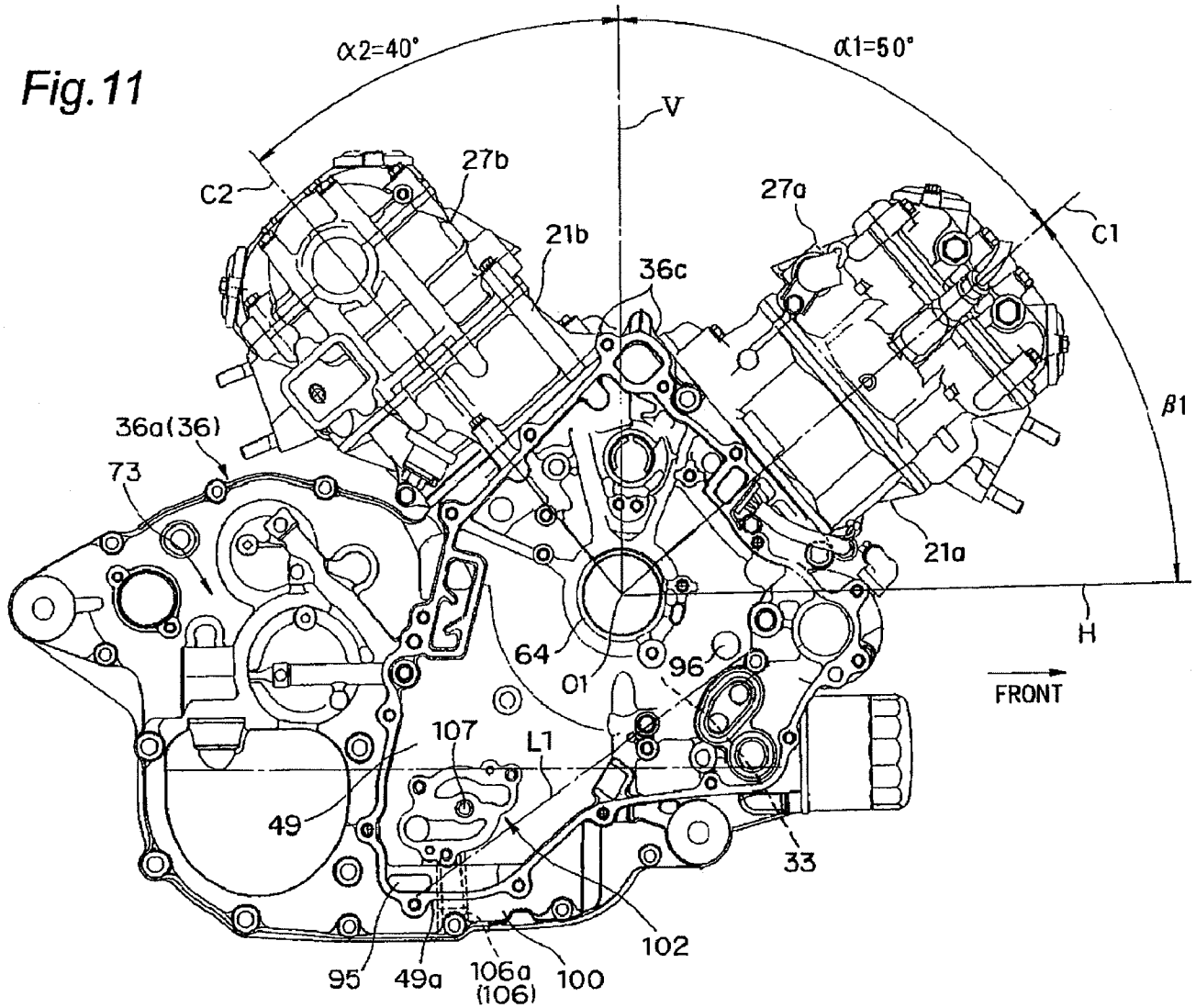
FIG. 11 is a right side view of a left crank case member according to yet another embodiment of the present invention.

FIG. 11 shows a third embodiment of a vehicle engine according to the present invention. The engine 20 is a V-type two-cylinder engine in which a front cylinder 21*a* inclined forward and a rear cylinder inclined rearward are arranged in an upper end of a front part of the crank case 36 so as to open upward in a V-type arrangement. A forward inclination angle α1 of a center line C1 of the front cylinder 21*a* relative to the vertical direction (vertical line V) is set to be 50°, and a rearward inclination angle α2 of a center line C2 of the rear cylinder 21*b* relative to the vertical direction (vertical line V) is set to be 40°. Therefore, an angle between the center line C1 of the front cylinder 21*a* and the center line C2 of the rear cylinder 21*b* (V-type opening angle α1+α2) is set to be 90°.

The third embodiment has the same configuration as the first embodiment except the front and rear cylinders 21*a* and 21*b* of the V-type arrangement. The same parts are given the same reference symbols as the first embodiment. Hereinafter, the oil circulation route and the structure of the generator chamber which are characteristics of the invention will be described again.

The generator chamber 49 formed on the right side of the crank case 36 spreads so as to occupy the majority of the front half part of the crank case 36 seen from the side. The bottom wall 49*a* of the generator chamber 49 is substantially horizontally formed at the position higher than the bottom surface of the oil pan 100 substantially corresponding to the lower end of the oil pump 102.

The first oil communication hole or opening 96 providing communication between the generator chamber 49 and the crank chamber 33 (refer to FIG. 2) is opened in the wall part of the right crank case member 36*a* between the generator chamber 49 and the crank chamber 33 (refer to FIG. 2) at a position slightly on the front side of the bearing hole 64 for the crankshaft. Further, the second oil communication hole or opening 95 providing communication between the transmission chamber 73 and the generator chamber 49 in the wall part of the right crank case member 36*a* at the position substantially corresponding to the rear lower end of the generator chamber 49. Part of the oil in the crank chamber 33 is discharged (returned) to the oil pan 100 of the transmission chamber 73 via the generator chamber 49 by utilizing the first oil communication hole or opening 96 and the second oil communication hole or opening 95.

As described above, the second oil communication hole or opening 95 is arranged at the position substantially corresponding to the rear lower end of the generator chamber 49. The second oil communication hole or opening 95 is also positioned on the upper side of the upper edge of the oil intake port 106*a* of the oil pump 102 where the oil remains at least in the entire area of the oil pan 100 when the vehicle is inclined forward by the angle substantially corresponding to the complementary angle β1 of the inclination angle α1 of the front cylinder relative to the substantially horizontal direction.

That is, the position of the second oil communication hole or opening 95 is set so that even when the vehicle is inclined forward by the angle substantially corresponding to the complementary angle β1 relative to the substantially horizontal direction (horizontal line H) and hence the oil flows back from the transmission chamber 73 to the generator chamber 49 via the second oil communication hole or opening 95, at least the minimum oil level L1 is maintained in the transmission chamber 73. Thereby, the oil in the oil pan 100 remains at least in the entire area of the oil pan 100.

The first oil communication hole or opening 96 is positioned below the lower end of the bore portion 36*c* in the front end of the crank case 36 and above the upper end of the oil pump 102.

By setting the first oil communication hole or opening 96 at the above position, when the vehicle is inclined forward by the predetermined angle β1 relative to the substantially horizontal direction as described above, the oil does not flow out from the crank chamber 33 into the front cylinder 21*a*.

In a case where the vehicle is inclined forward on the downward slope or the like at the time of driving the vehicle, part of the oil in the transmission chamber 73 flows back to the generator chamber 49 via the second oil communication hole or opening 95. However, the oil level in the transmission chamber 73 is suppressed to the position substantially in the lower end of the second oil communication hole or opening 95. Thereby, the oil remains at least in the entire area of the oil pan 100. Therefore, it is possible to suction and discharge the oil by the oil pump 102 without causing the air entrainment phenomenon so as to maintain the favorable oil circulation.

It should be noted that the oil pump shaft 107 is soaked in the oil when the engine is stopped in a horizontal state. However, since the oil level in the oil pan 100 is reduced at the time of operating the engine, the oil pump shaft 107 is not soaked in the oil. Since the oil pump shaft 107 has less resistance in this state of not soaked in the oil, the output loss is decreased so as to favorably operate the engine.

Further, in a case where the vehicle is inclined by the angle β1 as described above, the oil is moved forward in the crank chamber 33. However, the movement of the oil is controlled so that the oil does not enter at least the front cylinder 21*a*.

(Other Embodiments)

(1) In the first and second embodiments, the present invention is applied to the engine having the single cylinder, the vehicle engine in which the center line C1 of the cylinder is inclined forward by the inclination angle of 70° relative to the vertical direction. However, the present invention may be applied to a cylinder in which a center line C1 of the cylinder is inclined by an appropriate inclination angle of 60° or more relative to the vertical direction.

(2) The rotor housing chamber communicating with the first oil communication hole or opening and the second oil communication hole or opening is the generator chamber 49 on the right side of the crank chamber 33 in the above embodiments. However, the rotor housing chamber may be the clutch chamber 41 on the left side of the crank chamber 33. That is, the first oil communication hole or opening may provide communication between the crank chamber 33 and the clutch chamber 41 and the second oil communication hole or opening may provide communication between the clutch chamber and the transmission chamber.

(3) In the third embodiment of the V-type engine, the present invention may also be applied to a vehicle in which the center line C1 of the front cylinder 21*a* is inclined by an appropriate inclination angle of 45° or more relative to the vertical direction. Further, the present invention may be applied to a V-type engine in which the angle between the center line C1 of the front cylinder 21*a* and the center line C2 of the rear cylinder 21*b* (α1+α2) is set to be 90° or more, or a V-type engine in which the angle (α1+α2) is set to be less than 90°. Further, the present invention may be applied to a vehicle provided with a V-type engine in which both the cylinders in the V-type arrangement open in the left and right direction relative to the forward traveling direction of the vehicle.

(4) The present invention is not limited to the engine provided in the four-wheeled vehicle for irregular terrain as in FIG. 1 but may be applied to a vehicle engine provided in various vehicles such as a two-wheeled motor vehicle and a three-wheeled vehicle.

(5) The present invention is not limited to the structure of the above embodiments but may include various modifications obtained within a range not departing from a scope of claims.

What is claimed is:

1. A vehicle provided with an engine, the engine, comprising:

a) a crank case having a crank chamber housing a crankshaft, and a transmission chamber housing a transmission and including an oil pan in a lower end thereof;

b) a single cylinder coupled with the crank case, the cylinder having a center line inclined forward by an inclination angle of 60° or more relative to a vertical direction;

c) a cover member attached to one end of the crank case in the crankshaft direction, the cover member having a rotor housing chamber housing a rotor;

d) a first oil communication hole or opening formed at a side wall of the crank case between the crank chamber and the rotor housing chamber for providing communication between both the chambers so as to distribute oil;

e) a second oil communication hole or opening formed at the side wall of the crank case between the rotor housing chamber and the transmission chamber for providing communication between both the chambers so as to distribute the oil; and f) an oil pump communicating with an oil intake port formed in the oil pan, wherein g) the second oil communication hole or opening is arranged at a position substantially corresponding to a lower end of the rotor housing chamber above the oil intake port where the oil remains in the oil pan when the vehicle is inclined by a predetermined angle substantially corresponding to a complementary angle of the inclination angle of the cylinder relative to a substantially horizontal direction.

2. The vehicle according to claim 1, wherein the first oil communication hole or opening is arranged at a position in proximity to a lower end of the crank chamber seen in the crankshaft direction where an oil level in the crank chamber is maintained so that the oil in the crank chamber does not flow into the cylinder when the vehicle is inclined by the predetermined angle.

3. The vehicle according to claim 1, wherein a bottom wall of the crank chamber has an oil discharge hole or opening for discharging the oil in the crank chamber to the transmission chamber by rotation of the crankshaft.

4. The vehicle according to claim 3, wherein a peripheral wall of the crank chamber has a ventilation hole or opening for providing communication between an interior and an exterior of the crank chamber so as to distribute gas.

5. A vehicle provided with an engine, the engine, comprising:

a) a crank case having a crank chamber housing a crankshaft, and a transmission chamber housing a transmission and including an oil pan in a lower end thereof;

b') a pair of front and rear cylinders coupled with the crank case in a V-type arrangement, the front cylinder having a center line inclined forward by an inclination angle of 45° or more relative to a vertical direction and the rear cylinder having a center line inclined so as to make a predetermined angle relative to the center line of the front cylinder;

c) a cover member attached to one end of the crank case in the crankshaft direction, the cover member having a rotor housing chamber housing a rotor;

d) a first oil communication hole or opening formed at a side wall of the crank case between the crank chamber and the rotor housing chamber for providing communication between both the chambers so as to distribute oil;

e) a second oil communication hole or opening formed at the side wall of the crank case between the rotor housing chamber and the transmission chamber for providing communication between both the chambers so as to distribute the oil; and f) an oil pump communicating with an oil intake port formed in the oil pan, wherein g) the second oil communication hole or opening is arranged at a position substantially corresponding to a lower end of the rotor housing chamber above the oil intake port where the oil remains in the oil pan when the vehicle is inclined by a predetermined angle substantially corresponding to a complementary angle of the inclination angle of the cylinder relative to a substantially horizontal direction.

6. A vehicle provided with an engine, the engine, comprising:

a) a crank case having a crank chamber housing a crankshaft, and a transmission chamber housing a transmission and including an oil pan in a lower end thereof;

b) a single cylinder coupled with the crank case, the cylinder having a center line inclined forward by an inclination angle of 60° or more relative to a vertical direction;

c) a cover member attached to one end of the crank case in the crankshaft direction, the cover member having a rotor housing chamber housing a rotor;

d) a first oil communication hole or opening formed at a side wall of the crank case between the crank chamber and the rotor housing chamber for providing communication between both the chambers so as to distribute oil;

e) a second oil communication hole or opening formed at the side wall of the crank case between the rotor housing chamber and the transmission chamber for providing communication between both the chambers so as to distribute the oil; and f) an oil pump communicating with an oil intake port formed in the oil pan, wherein g') the second oil communication hole or opening is arranged at a position substantially corresponding to a lower end of the rotor housing chamber above the oil intake port where a line passing through a lower part of the second oil communication hole or opening in parallel to the center line of the cylinder runs higher than the oil intake port.

7. The vehicle according to claim 6, wherein the first oil communication hole or opening is arranged at a position in proximity to a lower end of the crank chamber seen in the crankshaft direction where an angle between a line connecting a lower part of the first oil communication hole or opening and a lower end of a bore portion of the crank case and a vertical line is the inclination angle of the cylinder or more.

8. A vehicle provided with an engine, the engine, comprising:

a) a crank case having a crank chamber housing a crankshaft, and a transmission chamber housing a transmission and including an oil pan in a lower end thereof;

b') a pair of front and rear cylinders coupled with the crank case in a V-type arrangement, the front cylinder having a center line inclined forward by an inclination angle of 45° or more relative to a vertical direction and the rear cylinder having a center line inclined so as to make a predetermined angle relative to the center line of the front cylinder;

c) a cover member attached to one end of the crank case in the crankshaft direction, the cover member having a rotor housing chamber housing a rotor;

d) a first oil communication hole or opening formed at a side wall of the crank case between the crank chamber and the rotor housing chamber for providing communication between both the chambers so as to distribute oil;

e) a second oil communication hole or opening formed at the side wall of the crank case between the rotor housing chamber and the transmission chamber for providing communication between both the chambers so as to distribute the oil; and f) an oil pump communicating with an oil intake port formed in the oil pan, wherein g') the second oil communication hole or opening is arranged at a position substantially corresponding to a lower end of the rotor housing chamber above the oil intake port where a line passing through a lower part of the second oil communication hole or opening substantially in parallel to the center line of the cylinder runs higher than the oil intake port.

9. An engine, comprising:

a) a crank case having a crank chamber housing a crankshaft, and a transmission chamber housing a transmission and including an oil pan in a lower end thereof;

b) a single cylinder coupled with the crank case, the cylinder having a center line inclined forward by an inclination angle of 60° or more relative to a vertical direction;

c) a cover member attached to one end of the crank case in the crankshaft direction, the cover member having a rotor housing chamber housing a rotor;

d) a first oil communication hole or opening formed at a side wall of the crank case between the crank chamber and the rotor housing chamber for providing communication between both the chambers so as to distribute oil;

e) a second oil communication hole or opening formed at the side wall of the crank case between the rotor housing chamber and the transmission chamber for providing communication between both the chambers so as to distribute the oil; and f) an oil pump communicating with an oil intake port formed in the oil pan, wherein g') the second oil communication hole or opening is arranged at a position substantially corresponding to a lower end of the rotor housing chamber above the oil intake port where a line passing through a lower part of the second oil communication hole or opening in parallel to the center line of the cylinder runs higher than the oil intake port.

10. The engine according to claim 9, wherein the first oil communication hole or opening is arranged at a position in proximity to a lower end of the crank chamber seen in the crankshaft direction where an angle between a line connecting a lower part of the first oil communication hole or opening and a lower end of a bore portion of the crank case and a vertical line is the inclination angle of the cylinder or more.

11. An engine, comprising:

a) a crank case having a crank chamber housing a crankshaft, and a transmission chamber housing a transmission and including an oil pan in a lower end thereof;

b') a pair of front and rear cylinders coupled with the crank case in a V-type arrangement, the front cylinder having a center line inclined forward by an inclination angle of 45° or more relative to the vertical direction and the rear cylinder having a center line inclined so as to make a predetermined angle relative to the center line of the front cylinder;

c) a cover member attached to one end of the crank case in the crankshaft direction, the cover member having a rotor housing chamber housing a rotor;

d) a first oil communication hole or opening formed at a side wall of the crank case between the crank chamber and the rotor housing chamber for providing communication between both the chambers so as to distribute oil;

e) a second oil communication hole or opening formed at the side wall of the crank case between the rotor housing chamber and the transmission chamber for providing communication between both the chambers so as to distribute the oil; and f) an oil pump communicating with an oil intake port formed in the oil pan, wherein g') the second oil communication hole or opening is arranged at a position substantially corresponding to a lower end of the rotor housing chamber above the oil intake port where a line passing through a lower part of the second oil communication hole or opening in parallel to the center line of the cylinder runs higher than the oil intake port.

* * * * *